US006340810B2

(12) United States Patent
Yokoyama et al.

(10) Patent No.: US 6,340,810 B2
(45) Date of Patent: Jan. 22, 2002

(54) DEVICE WITH INDUCTION HEATING ROLLER INCLUDING PROJECTING PORTIONS AT BOTH ENDS AND A CENTRAL PORTION OF A BOBBIN FOR MAINTAINING A GAP BETWEEN AN INNER SURFACE OF THE HEATING ROLLER AND A COIL ON THE BOBBIN

(75) Inventors: Hiroshi Yokoyama, Yokohama; Toshiaki Higaya, Kawasaki, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/847,376

(22) Filed: May 3, 2001

Related U.S. Application Data

(62) Division of application No. 08/977,559, filed on Nov. 25, 1997, now Pat. No. 6,255,632.

(30) Foreign Application Priority Data

Nov. 25, 1996 (JP) ..... 8-313497
Nov. 25, 1996 (JP) ..... 8-313498
Nov. 29, 1996 (JP) ..... 8-319441

(51) Int. Cl.[7] ..... H05B 6/14; H05B 6/36

(52) U.S. Cl. ..... 219/619; 219/676; 219/674; 399/328; 399/330; 336/207

(58) Field of Search ..... 219/619, 676, 219/672, 674, 216, 469, 470; 399/328, 329, 330, 335, 331, 336; 336/207, 208

(56) References Cited

U.S. PATENT DOCUMENTS 5,568,240 A * 10/1996 Ohtsuka ..... 219/619

FOREIGN PATENT DOCUMENTS

| | | | |
|---|---|---|---|
| JP | 57-52874 | * 11/1982 | |
| JP | 1-27191 | * 1/1989 | ..... 219/619 |
| JP | 1-265486 | * 10/1989 | ..... 219/619 |

* cited by examiner

*Primary Examiner*—Philip H. Leung
(74) *Attorney, Agent, or Firm*—Oblon, Spivak, McClelland, Maier & Neustadt, P.C.

(57) ABSTRACT

A device configured to be heated to a temperature sufficient to fuse an image forming substance to a sheet includes a hollow roller made of a conductive material and a coil arranged in a hollow portion of the hollow roller. The coil is configured to carry an electrical current that induces a current in the conductive material of the hollow roller such that the hollow roller becomes heated so as to fuse toner to a sheet. The coil is mounted on a member that is disposed in the hollow portion of the roller. The member includes various combinations of features that permit a reliable and safe operation of the induction heating apparatus such as recess and projections formed in the member to separate respective turns in the coil, a hollow center of the member that can be ventilated with a ventilation fan, and predefined gaps being maintained between the inside surface of the hollow roller and an outer surface of the coil.

19 Claims, 11 Drawing Sheets

DEVICE WITH INDUCTION HEATING ROLLER INCLUDING PROJECTING PORTIONS AT BOTH ENDS AND A CENTRAL PORTION OF A BOBBIN FOR MAINTAINING A GAP BETWEEN AN INNER SURFACE OF THE HEATING ROLLER AND A COIL ON THE BOBBIN

CROSS-REFERENCE TO RELATED APPLICATIONS

This application is a Division of application Ser. No. 08/977,559 Filed on Nov. 25, 1997, now U.S. Pat. No. 6,255,632.

This application contains subject matter related to application Ser. No. 08/383,181, filed Feb. 3, 1995, now U.S. Pat. No. 5,594,540 (Jan. 14, 1997); application Ser. No. 08/187,496, filed Jun. 20, 1995, now U.S. Pat. No. 5,426,495 (Jun. 20, 1995); application Ser. No. 07/893,050, filed Jun. 3, 1992, now U.S. Pat. No. 5,300,996 (Apr. 5, 1994), and reissue application Ser. No. 08/628,270, filed Apr. 5, 1996, all of which are incorporated herein by reference.

BACKGROUND OF THE INVENTION

1. Field of the Invention

The present invention relates to devices, such as image forming devices, that include a fixing device that affixes toner, or another image forming substance, to a sheet so as to make a toner image on the sheet.

2. Discussion of the Background

Image forming apparatuses, such as electrostatic copying machines, printers and facsimiles that employ an electrophotography process also include a fixing apparatus that fixes a toner image on a transfer paper. A conventional fixing apparatus includes a heating roller having a heating element therein and a press roller that contacts the heating roller. The conventional fixing apparatus is adapted to pass the transfer paper between the heating roller and press roller such that a toner image disposed on the transfer paper becomes fixed to the transfer paper as a result of heat imparted to the toner by the heating roller and pressure applied to the toner and transfer paper by the press roller and heating roller.

A quality of the bond between the toner and transfer paper depends on heat conditions of the fixing apparatus. For example, as the toner is heated beyond a predetermined melting temperature, the quality of the fixing process improves because the toner melts well. However, if the toner is not heated above the predetermined temperature, the quality of the fixing process is sub-optimal because the toner only partially melts.

Japanese Laid-Open Patent Application No. 53-50844 discloses an induction heating element in the form of a heating roller. As shown in FIG. 12, this heating roller includes a core 2 made of a magnetic material fixed to a shaft 1, a coil of wire 3 wound around the core, a roller member 5 which is an induction heating member rotatably supported by the shaft 1, and a heat-resistant and heat-insulating layer 4 arranged on an inner circumferential surface of the roller member. In the heating roller, a current (generally, 5 to 15 A) from a commercial power supply 8 is supplied to the coil via leads 6 and 7 to generate an induced current in the roller member 5. This induced current flows in the presence of an internal resistance in the roller member 5, which, according to the Joule effect, produces thermal energy, and thus heat, as a result of the induced current flow in the roller member 5.

In the induction heating system of FIG. 12, the coil 3 is arranged inside the roller member 5 and a high voltage is applied to the coil so as to supply a high current during a fixing operation in an attempt to heat the toner to a sufficient temperature. In addition, the roller member 5 covering the coil is made of a wire made of a conductive material having an internal resistance such that, when subjected to a high current, the wire itself produces heat, albeit a small amount. So respective windings in the coil 3 do not short-out to adjacent windings or to other conductive bodies, the wire is coated with an insulating layer. However, if a portion between the coil 3 is subjected to too much heat, there is a risk that a part of the insulating layer will deteriorate, thereby causing adjacent windings to short-out.

Generally, available insulating materials that are suitable for coating the wire are expensive, and the present inventors have identified that avoiding this expense by employing a structural alternative would be desirable, if possible. Furthermore, avoiding special steps for coating the wire with the special insulating materials would also be desirable.

FIG. 13 shows another conventional induction heating roller as disclosed in Japanese Laid-Open Patent Application No. 58-209887. This induction heating roller includes a hollow roller 231 and a supporting member 232 which supports the hollow roller 231. A solid core portion 234 is included and an induction coil 233 is mounted on an outer periphery of the solid core portion 234. A supporting shaft 236 which protrudes from each side of the core portion 234 rotatably supports a hollow shaft portion 238 of the hollow roller 231 via a bearing 237. Further, on the supporting shaft 236, there is provided a lead wire 239, one end of which is connected to the induction coil 233. The lead wire 239 is led out of the supporting shaft 236 to connect to a power supply (not shown). In addition, a jacket 241 is put on the supporting member 232 and a cylindrical thermal insulating material 242 is concentrically wound around the induction coil 233.

In this induction heating roller, a refrigerant is circulated through the jacket 241, as shown, to cool the supporting member 232, thereby preventing the induction coil 233 from receiving conduction heat from the hollow roller 231. In addition, the thermal insulating material 242 is used to intercept radiation heat and convection heat generated by the hollow roller 231, thereby preventing the induction coil 233 from being exposed to the heat. Thus, the induction heating roller of FIG. 13 addresses the concern of overheating the induction coil 233 by a combining an active cooling mechanism with sufficient thermal insulating material.

As recognized by the present inventors, the conventional heating roller of FIG. 13 is an expensive approach for solving the problem because this structure is complex in that (1) the thermal insulating material is wound around the induction coil, (2) the jacket is put on the supporting member, (3) the thermal insulating material is used and (4) the refrigerant is used. Another limitation with the device of FIG. 13, is that a copy operation start up period is relatively long because the refrigerant initially absorbs much of the thermal energy.

Another induction heating roller is disclosed in Japanese Granted Utility Model Application No. 57-52874, in which a supporting member is configured to support a hollow roller having an iron core therethrough. An induction coil is mounted about an outer periphery of the iron core, and the iron core supports the hollow roller via a bearing. At a precise location about the outer surface of the iron core, an electrical insulating spacer is provided for preventing a short-circuit to occur between the coil and the iron core. Other electrical insulating spacers, of a different type, are inserted about the core and between respective windings of the wire so as to prevent the windings from short-circuiting.

As recognized by the present inventors, a limitation with this conventional heating roller is that the process for forming the spacers on the heat roller is complex and thus expensive. Furthermore, this type of roller cannot be manufactured as quickly as other heating rollers, which is a significant manufacturing liability.

In the above-mentioned heating roller, the iron core is made of a magnetic material, although alternatively a bobbin made of a heat-resistant material may be used instead of this iron core. When the bobbin is used, and when the heating roller becomes hot, there is a risk that the bobbin shape will become deformed, perhaps in an eccentric shape. As a result of the deformation, a problem occurs in that the coil wound around the bobbin comes into contact with the roller member, thus resulting in the creation of an electrical leakage current or the like. The deformation problem becomes particularly pronounced when the induction heating roller is 15–50 millimeters in diameter and 1–2 millimeters in thickness and used in an image forming apparatus because it is difficult to maintain adequate gap-control between the hollow roller and the coil.

Furthermore, as the heating roller becomes bent as a result of pressure being applied thereto from the press roller, a problem occurs that, especially when the heating roller rotates at high velocity, the heating roller comes into contact with the coil, thereby resulting in electrical leakage.

SUMMARY OF THE INVENTION

Accordingly, one object of this invention is to provide a novel heating roller adapted for use in a fixing device that overcomes the above-mentioned limitations of existing methods and systems.

Another object of the present invention is to provide a safe induction heating roller, a safe roller heating apparatus that employs the induction heating roller, and a safe image forming apparatus that employs the roller heating apparatus, each of which minimize a risk of short-circuiting a coil wire.

Yet another object of the present invention is to provide a safe induction heating roller, roller heating apparatus, and image forming apparatus which prevent from occurring an electrical leak caused by a coil electrically connecting with a roller member.

Still another object of the present invention is to provide an induction heating roller which may be relatively simple to manufacture at a low-cost, yet avoid the possibility of damaging the induction coil as a result of heat-induced stress.

It is still a further object of the present invention to provide an induction heating roller that does not require a significant warm-up time so that a copy operation may be speedily initiated after energizing the heating roller.

The above and other objects and novel features of the present invention are achieved in a device configured to fuse an image forming substance to a sheet. The device includes a hollow roller made of a conductive material and a coil arranged in a hollow portion of the hollow roller. The coil is configured to carry an electrical current that induces a current in the conductive material of the hollow roller such that the hollow roller becomes heated so as to fuse toner to the sheet. The coil is mounted on a member that is disposed in the hollow portion of the roller. The member includes various combinations of features that permit a reliable and safe operation of an induction heating apparatus such as recesses and projections formed in the member to separate respective turns in the coil, a hollow center of the member that can be ventilated with a ventilation fan, and predefined distances set between the inside surface of the hollow roller and an outer surface of the coil.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
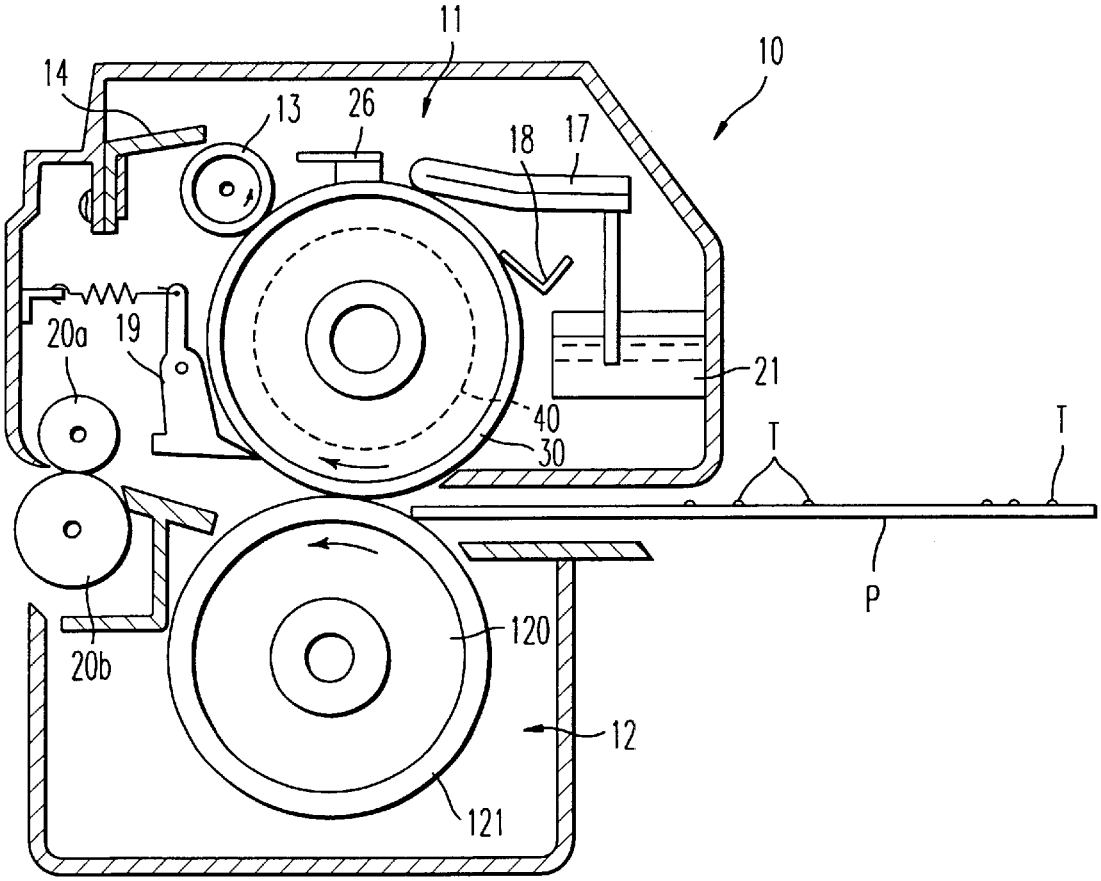
FIG. 1 is a cross-sectional view of a fixing apparatus including an inductive heating roller according to a first embodiment of the present invention.

Referring now to the drawings, wherein like reference numerals designate identical or corresponding parts throughout the several views, and more particularly to FIG. 1 thereof, a fixing apparatus of an image forming apparatus that includes the inductive heating roller of the present invention.

In FIG. 1, a fixing apparatus 10 of the image forming apparatus includes an induction heating roller 11, a press roller 12 that contacts the heating roller 11 by a pressing element (not shown), a cleaning roller 13 which contacts the heating roller 11 and removes toner or paper dust attached to the heating roller 11. A blade 14 is positioned to contact the cleaning roller 13 so as to scrape away deposits such as used toner that remains attached to the cleaning roller 13. Felt 17 is provided for coating a releasing agent 21 on an outer circumferential surface of the heating roller 11 and a releasing agent blade 18 is provided for scraping away an excess amount of the releasing agent 21 coated by the felt 17. A pick-off pawl 19 is provided for separating a transfer paper P whose toner image formed thereon has been fixed by the heating roller 11 and the press roller 12. A pair of discharging rollers 20*a* and 20*b* is provided for discharging the transfer paper P separated by the pick-off pawl 19.

Near a surface of the heating roller 11, there is arranged a thermistor 26 for detecting a temperature of the heating roller 11. The temperature information detected by the thermistor 26 is input to a power supply device (not shown) that controls an amount of power applied to the heating roller 11 based on the temperature information from the thermistor 26 so as to maintain the temperature of the heating roller 11 at a predetermined temperature.

The press roller 12 includes a core metal 120 made of metal, for example, an aluminum alloy, and a rubber layer 121 made of silicon rubber formed around the outer circumferential surface of the core metal 120.

The heating roller 11 includes a hollow roller 30 which forms an outer circumferential portion of the heating roller 11, and a core portion 40 arranged inside the roller 30. The heating roller 11 may be configured to have a diameter in a range of 15–50 millimeters in diameter and 1–2 millimeters in thickness, where the actual size will correspond with the requirements of the image forming apparatus or fixing device in which the heating roller 11 is used.

Figure 2:
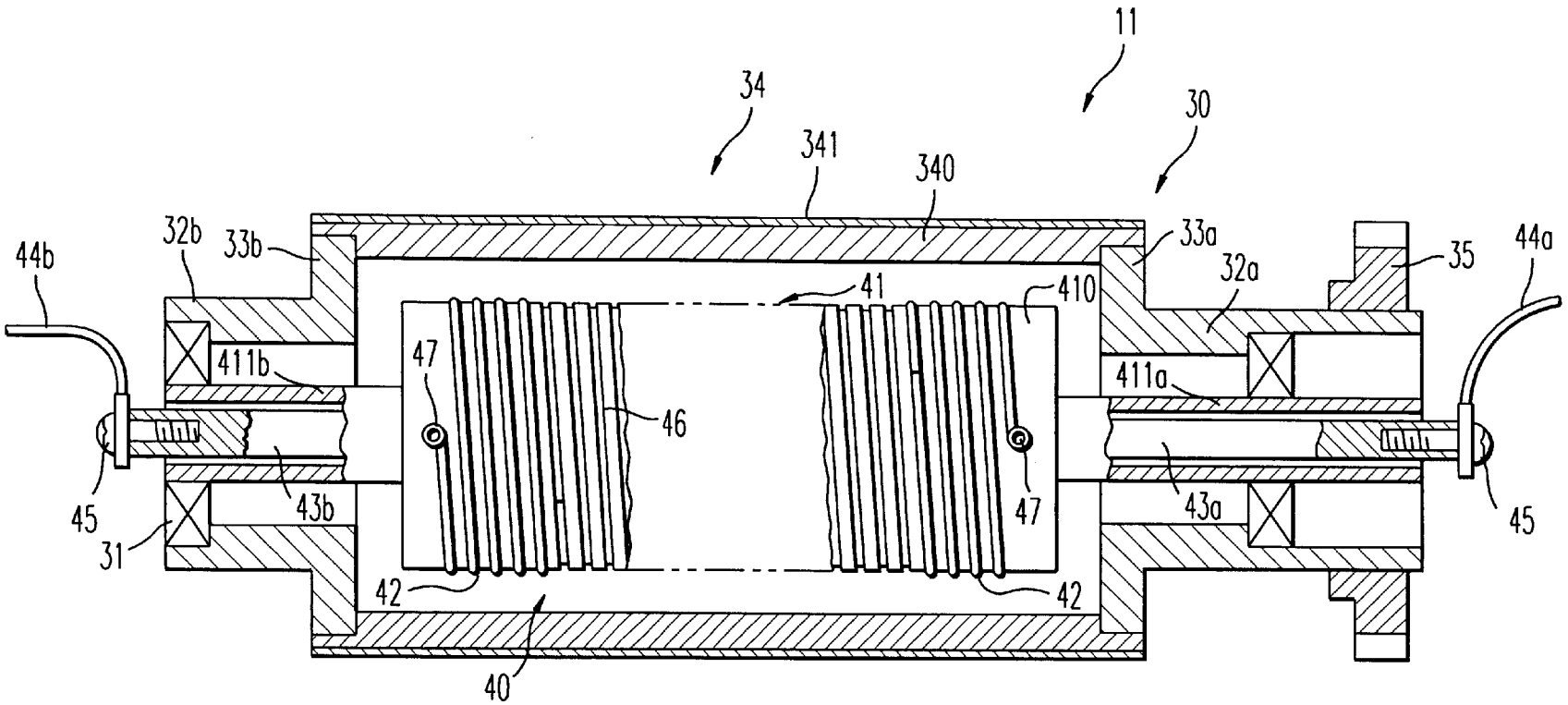
FIG. 2 is a partial cross-sectional view of the inductive heating roller according to the first embodiment.

As shown in FIG. 2, the core portion 40 of the heating roller 11 includes a bobbin 41 made of a heat-resistant and electrical insulating resin, for example, a synthetic material like nylon or polyester that has been doped with a flame-retarding material. The bobbin 41 has wrapped about a peripheral surface (as will be discussed) an induction coil 42 that is powered by current from electrodes 43*a* and 43*b*, which connect to lead wires 44*a* and 44*b* respectively. The bobbin 41 is formed in a cylindrical shape, the central portion of which is formed as a large-diameter portion 410 in an axial direction, and small-diameter portions 411*a* and 411*b* are formed at both ends of the large-diameter portion 410, as shown.

The outer ends of the small-diameter portions 411*a* and 411*b* are fixed to side plates (not shown) of the fixing apparatus 10, respectively. In the small-diameter portions 411*a* and 411*b*, cylindrical electrodes 43*a* and 43*b* are respectively arranged as shown. At the ends of the electrodes 43*a* and 43*b* that connect to the large-diameter portion 410, fixing members 47, described later, are electrically connected to the electrodes. The other ends of the electrodes 43*a* and 43*b* have lead wires 44*a* and 44*b* are secured thereto by screws 45, as shown. The lead wires 44*a* and 44*b* are connected to the power supply device, not shown, where the power supply provides a predetermined amount of power via the lead wires 44*a* and 44*b*.

Figure 3:
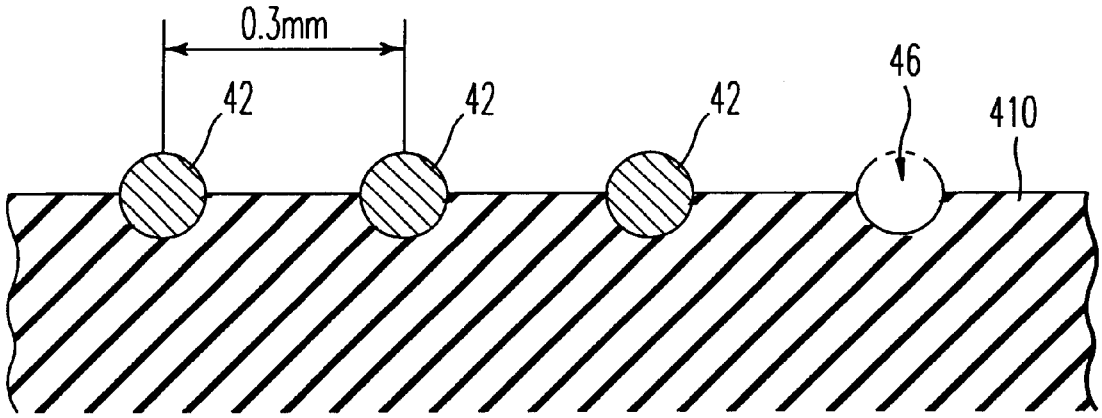
FIG. 3 is a partial cross-sectional view of a bobbin portion and a coil portion of the inductive heating roller according to the first embodiment.

On the surface of the large-diameter portion 410 of the bobbin 41, a continuous spiral slot 46 is formed, extending from one end of the large-diameter portion 410 to the other end thereof. As shown in FIG. 2, and in more detail in FIG. 3, the slot 46 has almost the same shape as the outer peripheral shape of a wire that forms the induction coil 42 so that the wire fits neatly into the slot 46. A depth of the slot 46 is shown to be almost the same as a radius of a wire of the induction coil 42. The spacing between the turns of the slot 46 is set to approximately 0.3 mm, as shown in FIG. 3. The surface of the large-diameter portion 410 of the bobbin 41 may be described as having recessed and projection features formed thereon where the recesses are defined by the slot 46 and the projections are defined by areas therebetween.

Around the large-diameter portion 410, the induction coil 42 is wound along the slot 46. Both ends of the induction coil 42 are terminated by the fixing members 47 that are disposed on the outer circumferential surface at end portions of the large-diameter portion 410. The fixing members 47 are made of a conductive material and are connected with the electrodes 43*a* and 43*b* as described above.

On the small-diameter portions 411*a* and 411*b* of the bobbin 41, support tubes 32*a* and 32*b* are rotatably supported via respective roller bearings 31. The support tubes 32*a* and 32*b* have flanges 33*a* and 33*b*, respectively, which oppose each other. A cylindrical roller 34 is arranged between the flanges 33*a* and 33*b* such that both ends of the roller 34 are mated with the flanges 33*a* and 33*b*, respectively, and the roller 34 is fixed to the flanges 33*a* and 33*b* with screws (not shown).

The roller 34 includes a core metal member 340 made of a conductive magnetic member, for example, iron, stainless steel or the like, and a releasing agent layer 341 which is made of a resin which is formed on the outer circumferential surface of the core metal member 340. The resin allows the toner T to be more easily released from the roller 34. The hollow roller 30 includes the roller 34 and the support tubes 32*a* and 32*b*, as shown.

A gear 35 is fixed to the support tube 32*a*, and a drive gear (not shown) is mated with the gear 35. When the gear 35 is rotated by the drive gear, the hollow roller 30 rotates around the outer periphery of the bobbin 41.

In light of the above discussion about the structure of the heating roller 11, a description of how the heating roller 11 operates will now be provided. Because the wire of the induction coil 42 is set in the spiral slot 46, a relative, lateral movement of the wire is restricted and thus short circuiting of adjacent turns in the coil 42 is avoided even though the induction coil 42 is subjected to a variety of operational conditions. Therefore, even if the conductive portions of the wire become exposed as a result of an outer insulating coat becoming damaged or fused, the exposed portions will not touch one another, thereby avoiding a short-circuit event and improving the safety of the apparatus. In addition, even when an inexpensive wire is used, which generally has a relatively low heat resistance, it is possible to prevent short-circuiting caused by adjacent wire turns contacting one another, and therefore the induction coil 42 can reliably be used, while the cost of the wire is reduced.

Furthermore, because the bobbin 41 requires a generally continuous groove to be formed therein during manufacturing, it is possible to manufacture the bobbin 41 with a straight-forward manufacturing process. Although the continuous spiral slot 46 is formed on the surface of the large-diameter portion 410 in this embodiment, the slot 46 may be formed with discontinuous sections, as long as the groove is configured to maintain a separation between adjacent wire turns (i.e., windings).

An operation of the fixing apparatus 10 is described below. As shown in FIG. 1, when a transfer paper P having a toner image formed thereon is conveyed to the fixing apparatus 10, the power supply device provides a high current, drawn from a commercial power source, to the induction coil 42 via lead wires 44*a* and 44*b*, electrodes 43*a* and 43*b*, and fixing members 47 (FIG. 2). By this current being supplied to the induction coil 42, another current is induced in the roller 34, and the heating roller 11 is heated to a predetermined temperature as a result of the Joule effect from this induced current. Thereafter, the transfer paper P is inserted between the heating roller 11 and the press roller 12 where the paper P is heated to the predetermined temperature and the toner T become affixed thereto. Once the toner T is affixed to the transfer paper P, the transfer paper P is separated from the surface of the heating roller 11 by the pick-off pawl 19, which is spring biased, as shown, and then conveyed by way of a pair of the discharging rollers 20*a* and 20*b* to be discharged from the fixing apparatus 10.

A second embodiment will be described with respect to FIGS. 4 and 5. In the second embodiment, a shape of a large-diameter portion 2410 of a bobbin 241 is different from that of the first embodiment. Therefore, an explanation will be generally directed to the shape of the large-diameter portion 2410, and a discussion of the features of the second embodiment that are common with the first embodiment will be omitted.

Figure 4:
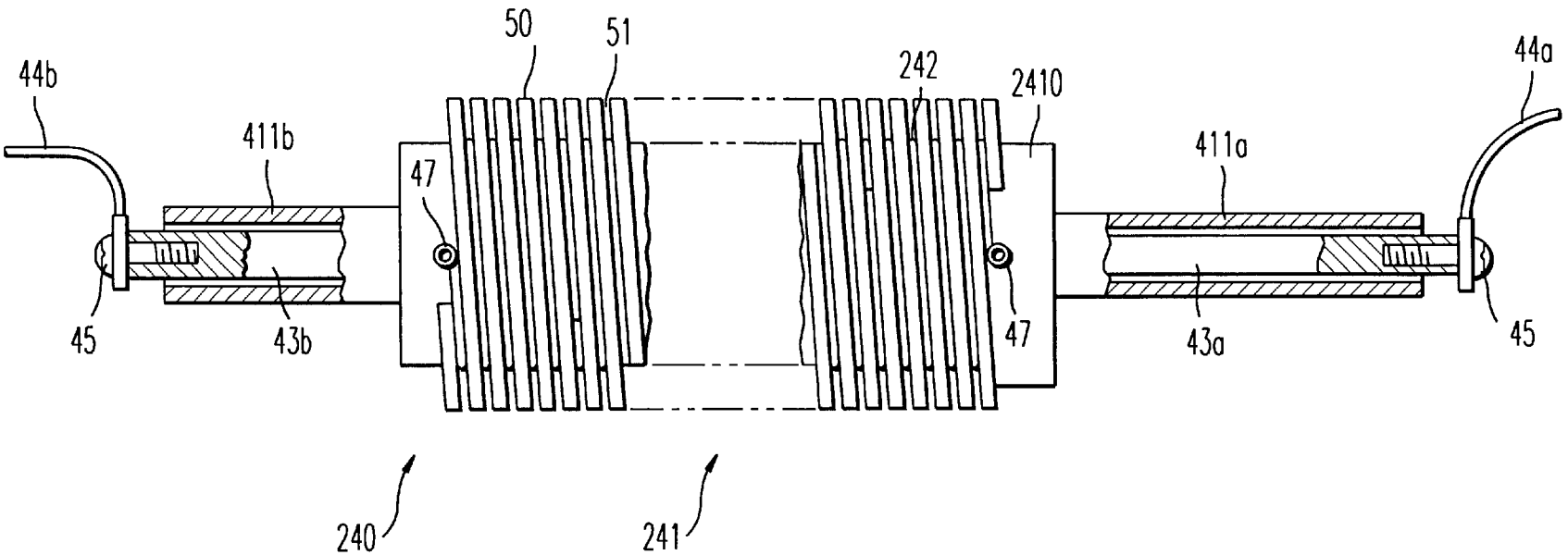
FIGS. 4 and 5 are partial cross-sectional views of a bobbin portion and a coil portion of an induction heating roller according to a second embodiment of the present invention.

As shown in FIG. 4, on the surface of the large-diameter portion 2410 of the bobbin 241, a spiral projection streak 50 is integrally formed from one end of the large-diameter portion 2410 to the other end thereof. A slot 51 is formed by a gap between neighboring turns of the projection streak 50; in other words, opposing faces of the neighboring turns of the projection streak 50 and an outer circumferential surface of the large-diameter portion 2410 define the slots therebetween. Along the slot 51, an induction coil 242 is wound around the large-diameter portion 2410.

Figure 5:
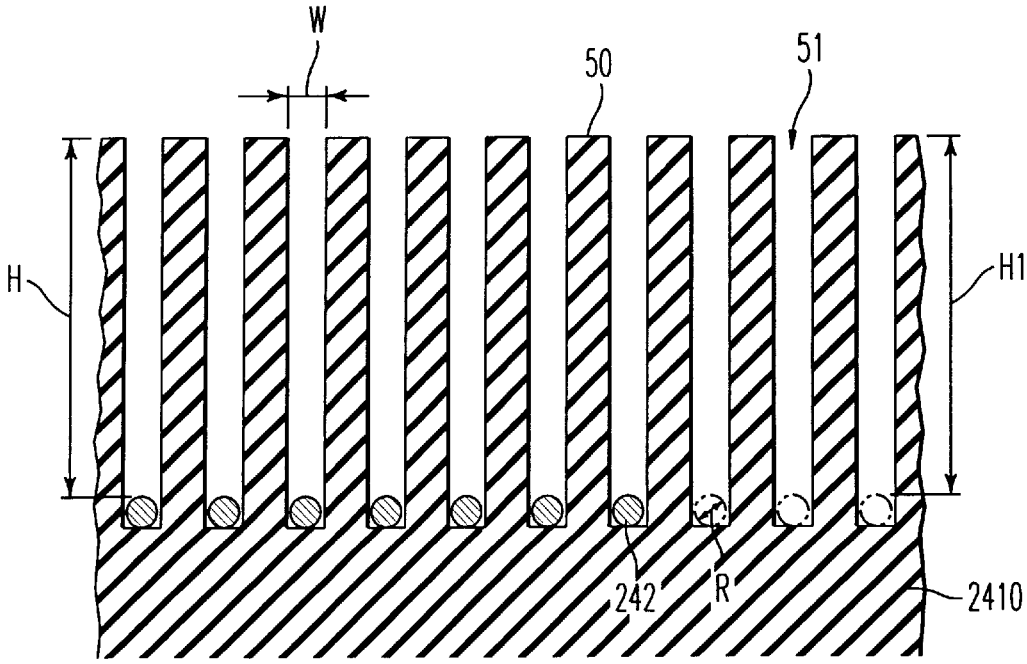

In FIG. 5, assuming that W (mm) indicates a width of the slot 51, H (mm) indicates a distance from an outer circumferential surface of the induction coil 242 in the slot 51 to an outer edge of the projection streak 50, and R (mm) indicates a diameter of a wire of the induction coil 242. The width W of the slot 51 and the distance H (mm) are set according to the relationships, $$W(\text{mm}) > R(\text{mm}),$$

and $$H(\text{mm}) \geqq 3 \text{ mm}.$$

In these conditions, a depth H1 (mm) of the slot 51 satisfies a relationship of $$H1(\text{mm}) \geqq 3 \text{ mm} + R(\text{mm}).$$

According to the above constitution, even if the bobbin 241 vibrates, a movement of the wire of the induction coil 242 is not sufficient to remove the wire from the slot 51. Therefore, safety standards such as those set by Underwriters Laboratory (UL), the Canadian Standard Association (CSA), or the like can be satisfied and the apparatus can be operated safely. In addition, although the slot 51 is formed by the projection streaks 50 in this embodiment, the same effect can be obtained by extending the depth of the slot 46 in the first embodiment. Thus, a variant of the second embodiment is a combination of the first embodiment and the structure shown in FIGS. 4 and 5.

Regarding the fabrication process of the heating roller, the projection streak 50 and the bobbin 241 are both made of resin. Accordingly, the projection streak 50 and the bobbin 241 may be formed in a one piece mold using an injection molding process.

Figure 6:
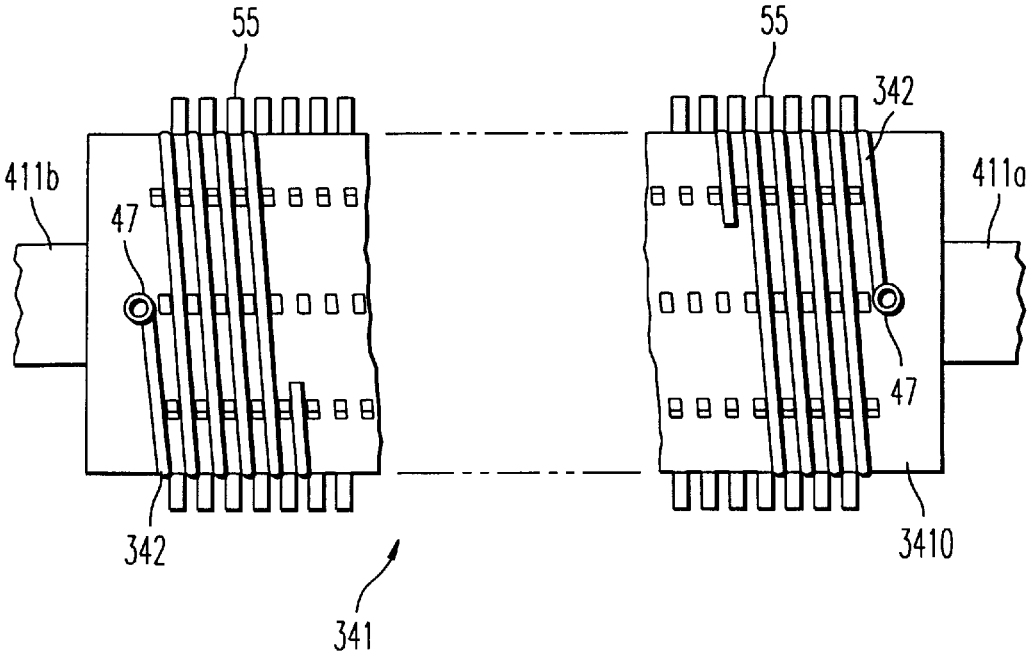
FIG. 6 is a side view of a bobbin portion of an induction heating roller according to a third embodiment of the present invention.

FIG. 6 illustrates a third embodiment that will be described below. In this third embodiment, a shape of a large-diameter portion 3410 of a bobbin 341 is different from that of the first embodiment. Therefore, an explanation will be generally directed to the shape of the large-diameter portion 3410, and features of the third embodiment that are common with the first embodiment will be omitted.

As shown in FIG. 6, on the surface of the large-diameter portion 3410 of the bobbin 341, numerous protrusions 55 are arranged radially from the center of the large-diameter portion 3410 at a fixed interval. The numerous protrusions 55 are spirally arranged on the surface of the large-diameter portion 3410 so as to spirally guide the wire of the induction coil 342. The wire of the induction coil 342 is wound on the surface of the large-diameter portion 3410 by threading the wire between the protrusions 55 so that neighboring turns of the wire of the induction coil 42 do not contact one another. A height of each protrusion 55 is sufficiently high to prevent respective turns in the induction coil 342 from jumping over the protrusions 55 when the wire is jostled, vibrated or subjected to thermal contraction/expansion. In addition, the wire of the induction coil 342 is wound on the surface of the large-diameter portion 3410 so that neighboring turns of the wire do not contact one another. Accordingly, the protrusions 55 need not be arranged at predetermined intervals, but may also be arranged at varying spacings (e.g., random spacing and/or varying spacings that follow a predetermined pattern) provided that the height and distance between the spacings is sufficient to maintain the separation of adjacent windings.

According to the above constitution, even if the bobbin 341 vibrates, a movement of the wire of the induction coil 3420 is reliably avoided. Therefore, safety standards such as those set by UL, CSA, or the like can be satisfied and the safety of an apparatus can be maintained. Furthermore, as with the second embodiment, because the protrusions 55 and the bobbin 341 are made of resin, they may be jointly formed in a single mold in an injection molding process.

Figure 7:
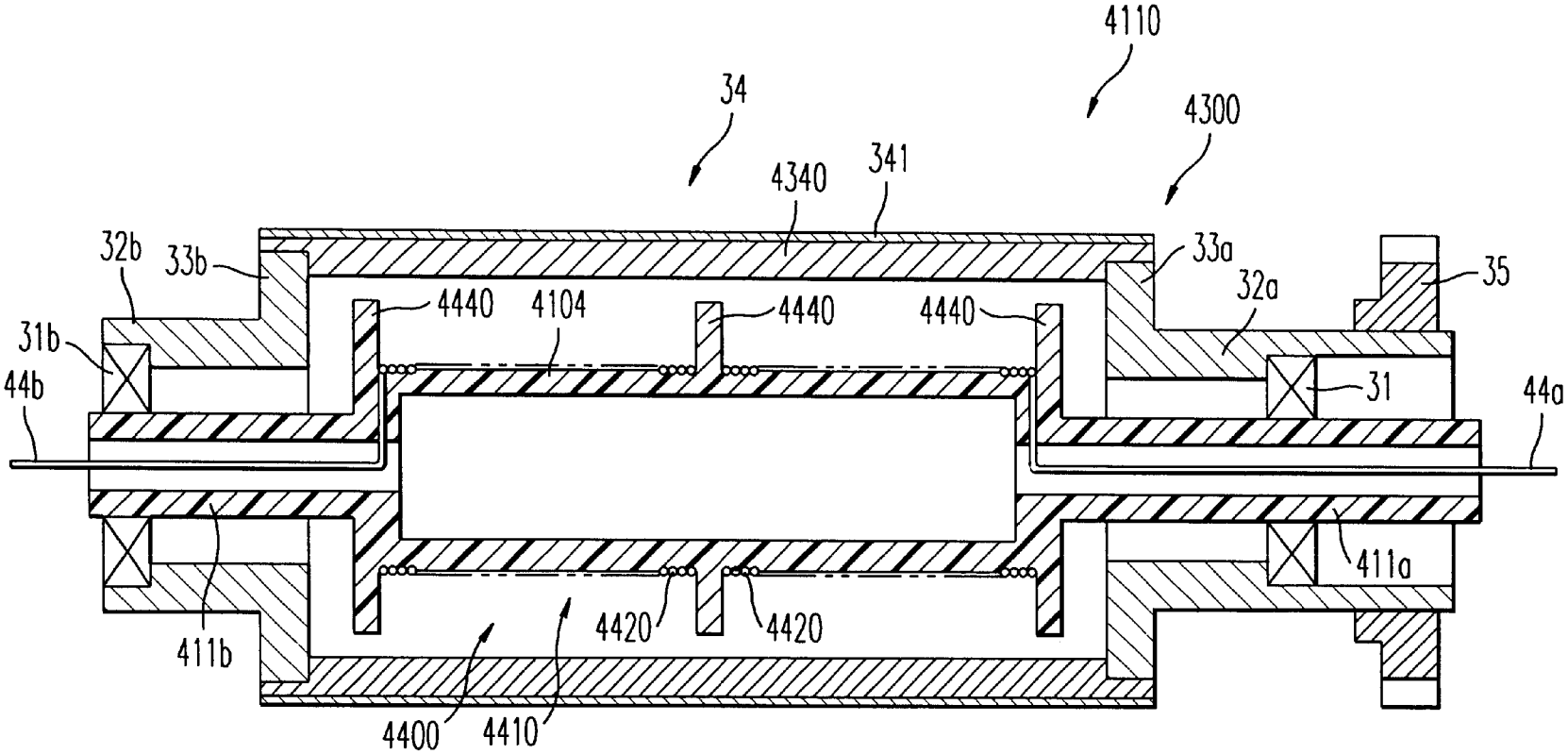
FIG. 7 is a cross-sectional diagram of an induction heating roller according to a fourth embodiment according of the present invention.
Figure 8:
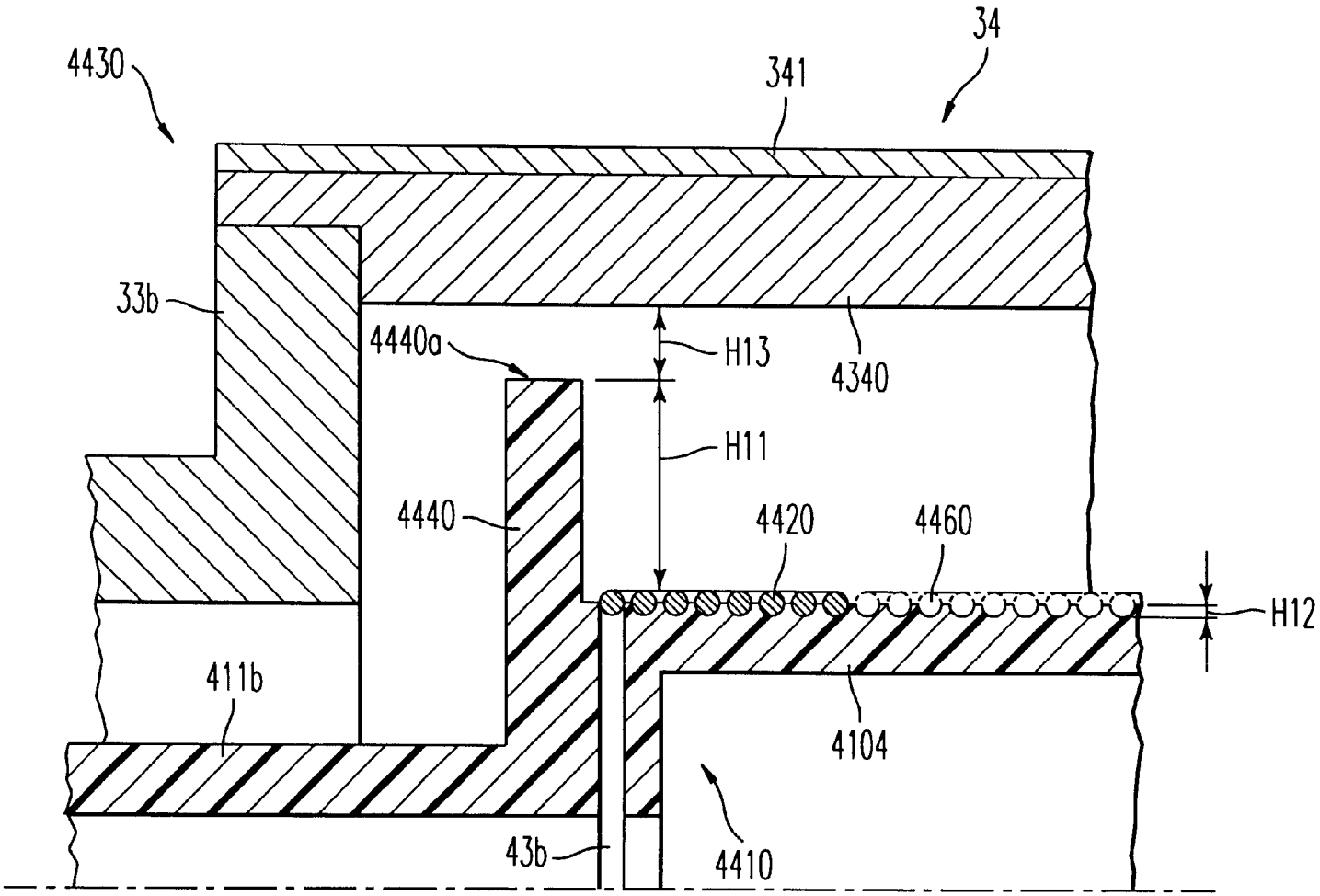
FIG. 8 is a partial cross-sectional diagram of a large-diameter portion of a bobbin of the induction heating roller of FIG. 7.

FIGS. 7 and 8 illustrate a fourth embodiment that will be described below. In the fourth embodiment, a shape of a core portion 4440 is different from that of the first embodiment and therefore an explanation will be made here only for the shape of the core portion 4440. Therefore, an explanation will be generally directed to the shape of the core portion, and features of the fourth embodiment that are common with the first embodiment will be omitted or simplified.

The heating roller 4110, as shown in FIG. 7, includes a hollow roller 4300 which forms an outer circumferential portion of the heating roller 4110, and a core portion 4400 arranged inside the roller 4300. The core portion 4400 includes a cylindrical bobbin 4410, an induction coil 4420, and lead wires 44*a* and 44*b* that provide electrical power to the induction coil 4420.

The bobbin 4410 includes a large-diameter portion 4104 formed in the central portion, in an axial direction of the bobbin 4410, and small-diameter portions 411*a* and 411*b* formed at both ends of the large-diameter portion 4104, respectively. Flange portions 4440 are formed near a central portion and at both ends of the large-diameter portion 4104. The flange portions 4440 are provided as projecting portions for maintaining a gap between the hollow roller 4300 and the induction coil 4420, even if the hollow roller 4300 becomes deformed.

As shown in FIG. 8, on the surface of the large-diameter portion 4104, a continuous spiral slot 4460 is formed from one end of the large-diameter portion 4104 toward the other end thereof. The shape of the slot 4460 is almost the same shape as a lower half portion of the outer peripheral shape of the wire of the induction coil 4420. Around the large-diameter portion 4104, the induction coil 4420 is wound so as to sit in the slot 4460. As shown in FIG. 7, both ends of the induction coil 4420 connect to the lead wires 44*a* and 44*b* embedded at the both ends of the large-diameter portion 4104, respectively. The lead wires 44*a* and 44*b* connect to a power supply device (not shown) and are passed through an inside of the small-diameter portions 411*a* and 411*b*. The amount of electrical power supplied is controlled by the power supply device.

From a viewpoint of safety, the bobbin 4410 is made of heat-resistant insulating resin, for example, a synthetic resin, such as nylon, polyester or the like which has a flame retardant material applied thereto. The bobbin 4410 includes the large-diameter portion 4104, the small-diameter portions 411*a* and 411*b* and the flange portions 4440, all of which may be formed using resin molding manufacturing processes.

Referring to FIG. 8, a height of an edge of the flange portion 4440 and a shape of the slot 4460 will be discussed. Assuming that H11 (mm) indicates a height of the edge of the flange portion 4440 having a tip end 4440*a,* (i.e., a distance from the outer circumferential surface of the induction coil 4420 to the tip end 4440*a* of the flange portion 4440), H12 (mm) indicates a depth of the slot 4460, and R (mm) indicates a diameter of the wire of the induction coil 42. The height of the edge of the flange portion 4440 and the depth of the slot 4460 are set so as to satisfy relationships of $$H11(\text{mm}) \geqq 3(\text{mm})$$

and $$H12(\text{mm}) = (1/2) \times R(\text{mm}),$$

respectively.

A gap H13 between the tip end 4440*a* of the flange portion 4440 and the inner circumferential surface of the roller 4340 is set to a distance in which both members do not contact each other even when the hollow roller 4430 rotates. In this embodiment, the gap H13 is set in the range of 0.5 to 1 (mm).

Although the bobbin 4410 is made of heat-resistant insulating resin so as to have resistance to heat of the heating roller 4110, eccentricity or deformation may occur over a period of time in the bobbin 4410 if the heat of the heating roller 4110 affects the bobbin 4410 when the bobbin 4410 is subject to vibration as well as heat.

In this embodiment, to counteract an eccentricity or deformation of the bobbin 4410, a plurality of the flange portions 4440 are integrated in the large-diameter portion 4104. The tip end 4440*a* of the flange portions 4440 contacts the inner circumferential surface of the roller 4340 when the eccentricity occurs, resulting in prevention of further eccentricity or deformation, thus preserving a gap between the outer circumferential surface of the induction coil 4420 and the inner circumferential surface of the roller 4340. Consequently, the induction coil 4420 is prevented from contacting the inner circumferential surface of the roller 4340. Accordingly, the risk of electrical current leakage is reduced relative to the risk of current leakage if the gap were not preserved by the flange 4440.

Because H11 (mm) is 3 (mm) or longer, even if the bobbin 4410 does experience some eccentricity or deformation, or even if the hollow roller is bent by a pressure from the press roller 121 (FIG. 1), the induction coil 4420 is reliably prevented from contacting the inner circumferential surface of the roller 4340. Accordingly, safety standards such as those levied by the UL, CSA or the like can be satisfied and the safety of the present apparatus is improved over conventional apparatuses.

Because the wire of the induction coil 4420 is wound along the slot 4460 formed on the surface of the large-diameter portion 4104, a relative movement of turns of the wire of the induction coil 4420 is restricted, thereby preventing the turns from contacting one another. Therefore, even if the conductive portions of the wire are exposed as a result of fusing or degradation of the insulating layer of the wire, it is possible to prevent short-circuiting caused by a contact between neighboring windings, resulting in improved safety.

In this embodiment, although the flange portions 4440 each have a shape of a circular plate, the flange portions 4440 may include fragments (such as prongs). In addition, a plurality of protrusions shaped like raised fragments can be arranged on the surface of the large-diameter portion 4104 as the projecting portions.

Figure 9:
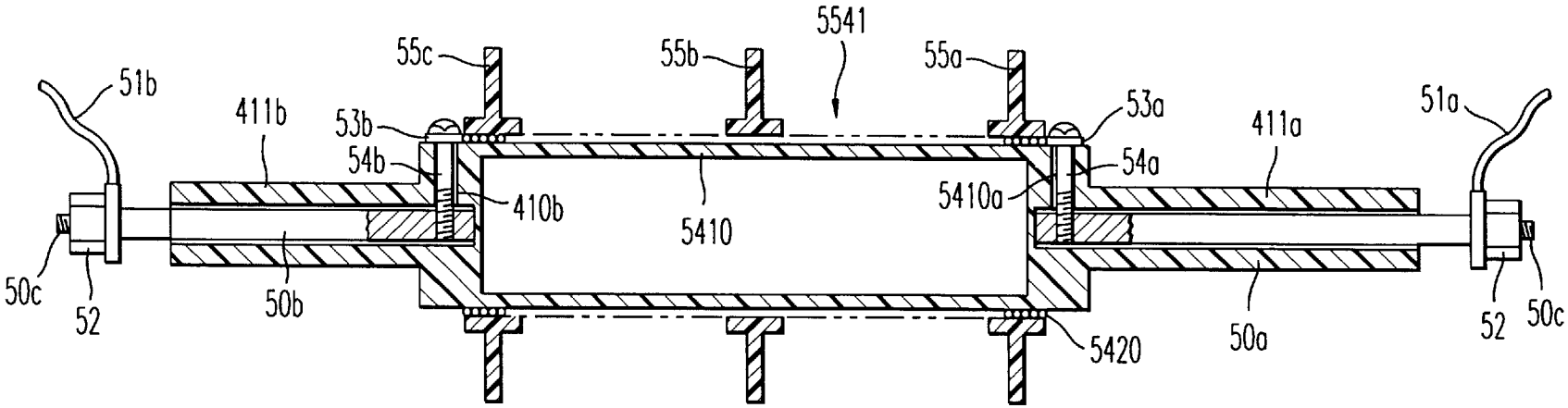
FIG. 9 is a partial cross-sectional view of the inductive heating roller according to a fifth embodiment of the present invention.
Figure 10:
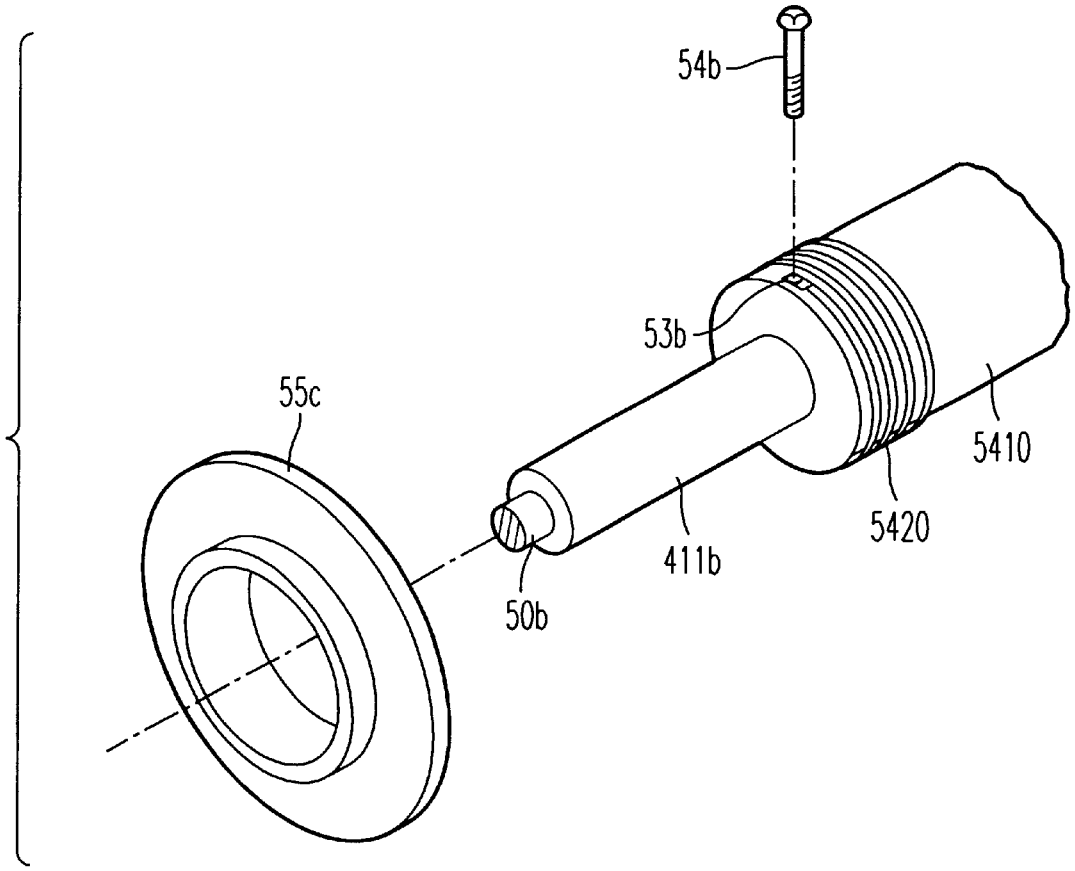
FIG. 10 is a perspective view of an end of a bobbin of the inductive heating roller of FIG. 9.

FIGS. 9 and 10 illustrate a fifth embodiment that is described below. Common elements in the first and fifth are represented in FIGS. 9 and 10 by the same reference numerals, and thus, the explanation of the common members is omitted here.

As shown in FIG. 9, on the both ends of the large-diameter portion 5410, holes 5410*a* and 5410*b* are formed which connect the small diameter portions 411*a* and 411*b,* respectively. On the large-diameter portion 5410 of the bobbin 5541, the induction coil 5420 is wound from the hole 5410*a* toward the hole 5410*b*.

On the large-diameter portion 5410 around which the induction coil 5420 is wound, spacers 55*a,* 55*b,* and 55*c* for forming a gap between the large-diameter portion 5410 and the inner circumferential surface of the roller are loosely fitted so as to be slidable over the outer circumferential surface of the induction coil 5420. The spacers 55*a,* 55*b,* and 55*c* are arranged near the center and at the both ends of the large-diameter portion 5410, respectively. The spacers 55*a,* 55*b,* and 55*c* have similar flange shapes and are made of a material having excellent heat resistance and wear-resistance, for example, a material of wear-resistance improved PI or PPC.

At the both ends of the induction coil 5420, there are provided fixing fragments 53*a* and 53*b* which also serve as electrodes. The fixing fragments 53*a* and 53*b* are arranged in the positions corresponding to the holes 5410*a* and 5410*b* and are fastened on the large-diameter portion 5410 with conductive screws 54*a* and 54*b*. Thus, the fixed fragments 53*a* and 53*b* are electrically connected to the electrodes 50*a* and 50*b* via the screws 54*a* and 54*b*.

Inside the small-diameter potions 411*a* and 411*b,* cylindrical electrodes 50*a* and 50*b* are arranged, respectively. As shown in FIG. 9, at inner ends of the electrodes 50*a* and 50*b* screw matching portions are provided with which screws 54*a* and 54*b* are matched, respectively. At the outer ends of the electrodes 50*a* and 50*b,* there are provided screw portions 50*c* on which lead wires 51*a* and 51*b* are fastened with nuts 52, respectively. The lead wires 51*a* and 51*b* are connected to the power supply device, which is not shown, and the amount of power supplied thereto is controlled by the power supply device.

According to the above-mentioned configuration, if the spacers 55*a,* 55*b,* and 55*c* contact the inner circumferential surface of the roller 340 due to a vibration of the bobbin 5541, the spacers 55*a,* 55*b,* and 55*c* rotate around the bobbin 5541 while sliding over the outer circumferential surface of the induction coil 5420. This sliding action inhibits the generation of a noise caused by a contact between components and wearing of the outer peripheral ends of the spacers 55*a,* 55*b,* and 55*c*.

The bobbin 5541 may be molded using a heat-resistant resin such as PPS (polyphenyiene sulfide), PEEK (polyether ether ketone), PES (poly ether), PI (polymide resins), and a liquid crystal polymer. The same effects obtained in the above embodiment can also be obtained when other heat-resistant resins are used.

Figure 11:
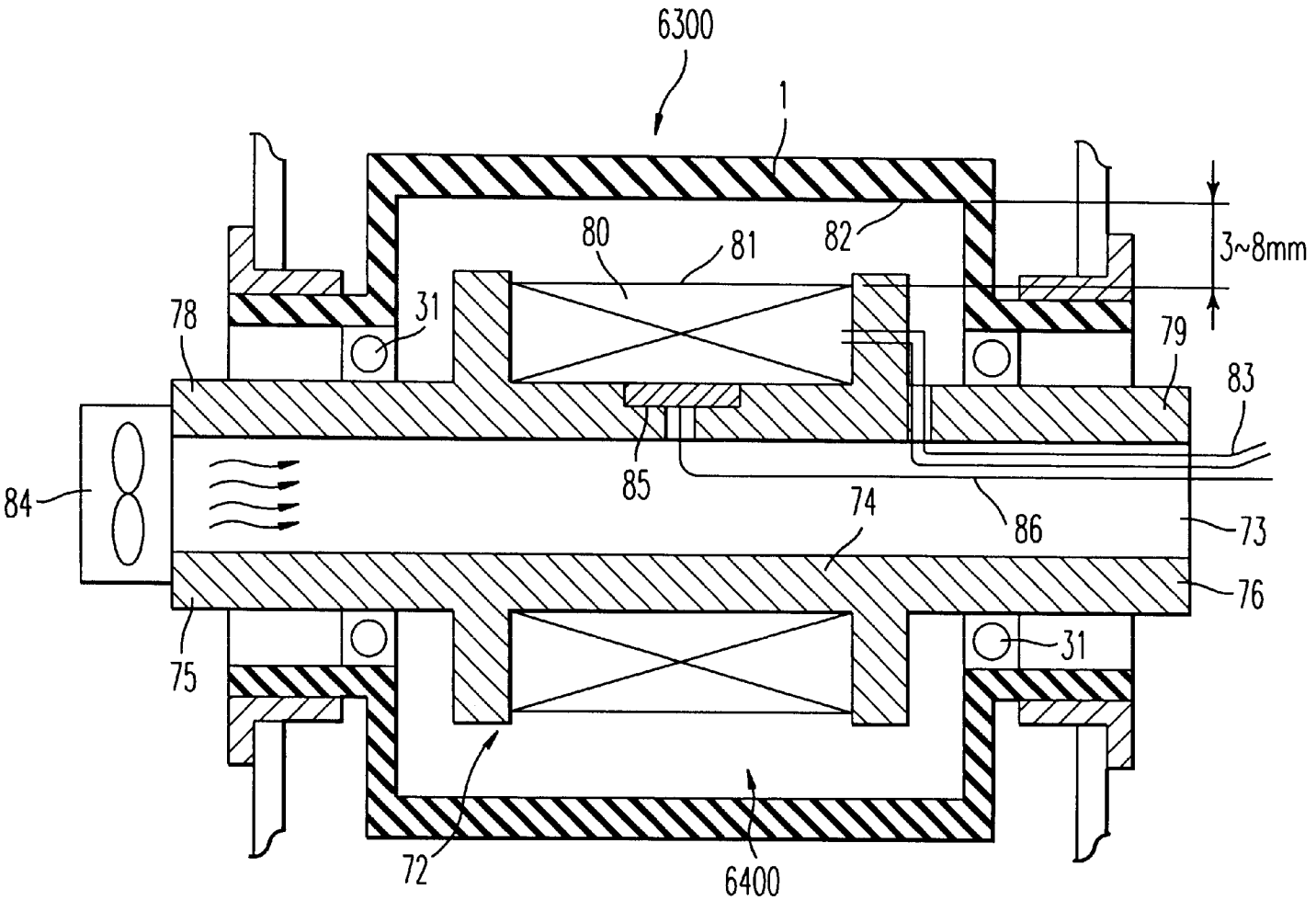
FIG. 11 is a cross-sectional view of an inductive heating roller according to a sixth embodiment of the present invention.
Figure 12:
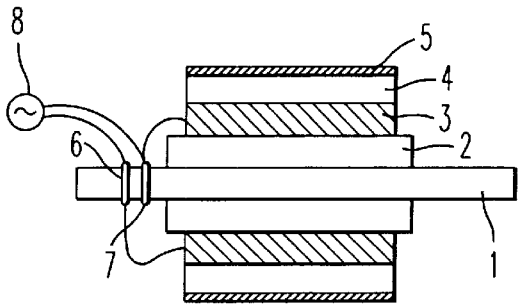
FIG. 12 Background Art
FIG. 12 is a cross-sectional view of a conventional inductive heating roller.
Figure 13:
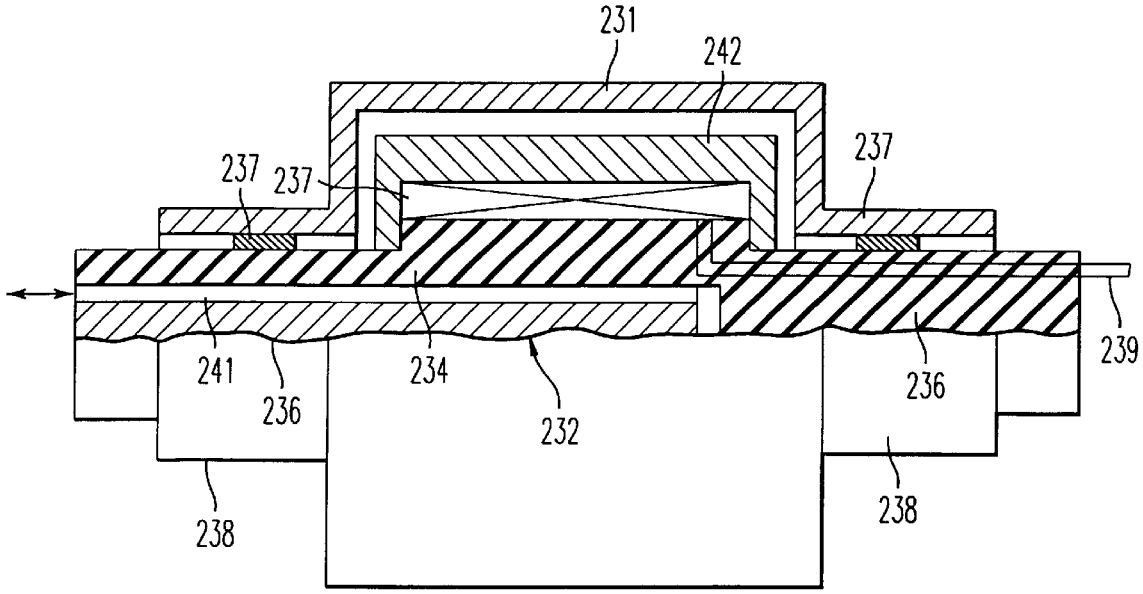
FIG. 13 Background Art
FIG. 13 is a partial cross-sectional view of another conventional heating roller.

FIG. 11 illustrates a sixth embodiment that will be described below. In the sixth embodiment, a core portion 6400 is different from that of the first embodiment, and thus, the different features will be described and a discussion of common features will be simplified or omitted.

In FIG. 11, a hollow roller 6300 is made of a magnetic material such as iron and has a releasing layer (not shown) made of Teflon resin, silicone rubber, fluororubber or the like on the outer circumferential surface thereof. A core member 72 supports the hollow roller 6300 and has a central hole 73, an induction coil supporting portion 74 and hollow roller supporting shafts 75 and 76 which are formed at both ends of the induction coil supporting portion 74. The hollow roller supporting shafts 75 and 76 rotatably support hollow shaft portions 78 and 79 of the hollow roller 6300 via a bearing 31.

The induction coil supporting portion 74 supports an induction coil 80. A distance in a radial direction from an outer circumferential surface 81 of the induction coil 80 to an inner circumferential surface 82 of the hollow roller 6300 is set to be in the range of 3 to 8 mm. The induction coil 80 is energized by an external power supply (not shown) by way of an energizing harness 83. In addition, a ventilating fan 84 is fixed on the hollow roller supporting shaft 75 so as to face the central hole 73. The induction coil supporting portion 74 is equipped with a temperature detector 85 that contacts the induction coil 80, and produces a detection signal that is sent to a controller, (not shown, although may be implemented as a digital signal processing device such as a microprocessor) by a bus 86 to control the operation of the ventilating fan 84.

In addition, it is possible, in this embodiment, that the core member 72 is made of a resin, which was noted in above-mentioned embodiments, as well as a metal.

In this embodiment, since a gap distance in a radial direction from the outer circumferential surface 81 of the induction coil 80 to the inner circumferential surface 82 of the hollow roller 6300 is 3 mm or greater, it is possible to prevent an adverse effect caused by heat radiation to affect the hollow roller 6300. Therefore, the induction coil 80 is prevented from being heated excessively, thereby preventing the induction coil 80 from being disconnected or damaged due to short-circuiting. Furthermore, the structure of this embodiment is such that it is possible to provide a low-cost induction heating roller having a simple structure.

Further since the gap distance is 8 mm or less, it is possible to prevent a reduction of a heat conversion efficiency of induction heating. Namely, when adapted for use in a fixing device, to which an image forming apparatus supplies at 400-2 k watts of power, the heating roller can be kept at high temperatures (generally near 200 degrees centigrade) at such that the toner image is reliably fixed on the transfer paper.

In addition, the ventilating fan 84, which is equipped with the hollow roller supporting shaft 75, is arranged to face the central hole 73 of the core member 72. The fan 84 does not operate until a predetermined temperature is detected by the temperature detector 85 which is arranged on the induction coil supporting portion 74 and contacts the induction coil 80.

When the temperature exceeds the predetermined temperature and a detection signal is output, the ventilating fan 84 starts to operate so that a cooling fluid (e.g., air) circulates through the central hole 73 of the core member 72 to cool the induction coil 80 via the core member 72. Thus the induction coil 80 is prevented from being heated excessively, thereby preventing the induction coil 80 from being disconnected or damaged due to short-circuiting. Further, at warm-up time, since the temperature of the induction coil 80 is lower than the predetermined temperature, the ventilating fan 84 is controlled by the controller to not operate, thereby avoiding unnecessary cooling and faster start-up time. As a consequence, the induction coil 80 is prevented from being disconnected or damaged due to short-circuiting, and accordingly it is possible to provide a low-cost induction heating roller having a simple structure.

In above-mentioned embodiment, the hollow roller 6300 is shaped to have tier portions, but the hollow roller 6300 may instead be shaped without the tier portions for ventilation considerations.

Regarding the controller for controlling the fan 84, or even the power supply, the controller may be implemented using a conventional general purpose microprocessor programmed according to the teachings of the present specification, as will be appreciated to those skilled in the relevant art(s). Appropriate software coding can readily be prepared by skilled programmers based on the teachings of the present disclosure, as will also be apparent to those skilled in the relevant art(s).

The present invention thus also includes a computer-based product which may be hosted on a storage medium and include instructions which can be used to program a computer to perform a process in accordance with the present invention. The storage medium can include, but is not limited to, any type of disk including floppy disk, optical disk, CD-ROMS, and magneto-optical disks, ROMS, RAMs, EPROMs, EEPROMs, flash memory, magnetic or optical cards, or any type of media suitable for storing electronic instructions.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A device configured to be heated to a temperature sufficient to fuse an image forming substance to a sheet, comprising:

a hollow roller being made of a conductive material and having an inner surface;

a coil arranged in a hollow portion of the hollow roller, the coil having a conductor that is configured to carry an electrical current that induces a current in, and heats, the conductive material of the hollow roller;

a bobbin being made of an electrically insulating resin, the bobbin arranged inside the coil, a surface of the bobbin having a recess configured to receive at least a portion of the conductor, the recess being a continuous spiral slot extending between ends of the bobbin; and a projecting portion integral with the bobbin disposed between the bobbin and the inner surface of the hollow roller so as to maintain a gap between the hollow roller and the coil, the projecting portion being made of an electrically insulating material, and being arranged on circumferential surfaces of both ends of the bobbin and near a central portion of the bobbin, wherein the conductor of the coil is wound along the bobbin and disposed within the recess so as to form windings of the coil, and the heat produced by said hollow roller is sufficient to fuse the image forming substance when said sheet is exposed to said heat.

2. The device of claim 1, wherein:

the bobbin comprises a heat resistant insulating resin, and a flame retardant material is applied to an outer surface of the bobbin.

3. The device of claim 2, wherein the heat resistant insulating resin comprises at least one of a synthetic resin, nylon, and polyester.

4. The device of claim 1, wherein:

the projecting portion has a height H11 being greater than or equal to about 3 mm, the conductor has a diameter R, and the recess has a depth H12 being equal to one-half of the diameter R.

5. The device of claim 1, wherein the recess is configured to have a same shape as a lower half portion of an outer peripheral shape of the conductor.

6. The device of claim 1, wherein the projecting portion is configured to form a gap between a top surface of the projecting portion and the inner surface such that the projecting portion does not contact the inner surface, the gap having a distance H12 between the top surface and the inner surface.

7. The device of claim 6, wherein the distance H12 is in a range from about 0.5 mm to about 1 mm.

8. The device of claim 1 wherein the recess is configured to maintain separation between adjacent windings of the coil.

9. The device of claim 1, wherein the projecting portion has a shape of at least one of a flange, a circular plate, and a raised fragment.

10. A fixing apparatus, comprising:

a heating roller, the heating roller having, a hollow roller being made of a conductive material and having an inner surface;

a coil arranged in a hollow portion of the hollow roller, the coil having a conductor that is configured to carry an electrical current that induces a current in, and heats, the conductive material of the hollow roller;

a bobbin being made of an electrically insulating resin, the bobbin arranged inside the coil, a surface of the bobbin having a recess configured to receive at least a portion of the conductor, the recess being a continuous spiral slot extending between ends of the bobbin; and a projecting portion integral with the bobbin disposed between the bobbin and the inner surface of the hollow roller so as to maintain a gap between the hollow roller and the coil, the projecting portion being made of an electrically insulating material, and being arranged on circumferential surfaces of both ends of the bobbin and near a central portion of the bobbin, wherein the conductor of the coil is wound along the bobbin and disposed within the recess so as to form windings of the coil, and the heat produced by the hollow roller is sufficient to fuse the image forming substance when the sheet is exposed to the heat.

11. The fixing apparatus of claim 10, wherein:

the bobbin comprises a heat resistant insulating resin, and a flame retardant material is applied to an outer surface of the bobbin.

12. The fixing apparatus of claim 11, wherein the heat resistant insulating resin comprises at least one of a synthetic resin, nylon, and polyester.

13. The fixing apparatus of claim 10, wherein:

the projecting portion has a height H11 being greater than or equal to about 3 mm, the conductor has a diameter R, and the recess has a depth H12 being equal to one-half of the diameter R.

14. The fixing apparatus of claim 10, wherein the recess is configured to have a same shape as a lower half portion of an outer peripheral shape of the conductor.

15. The fixing apparatus of claim 10, wherein the projecting portion is configured to form a gap between a top surface of the projecting portion and the inner surface such that the projecting portion does not contact the inner surface, the gap having a distance H12 between the top surface and the inner surface.

16. The fixing apparatus of claim 15, wherein the distance H12 is in a range from about 0.5 mm to about 1 mm.

17. The fixing apparatus of claim 10 wherein the recess is configured to maintain separation between adjacent windings of the coil.

18. The fixing apparatus of claim 10, wherein the projecting portion has a shape of at least one of a flange, a circular plate, and a raised fragments.

19. A device, comprising:

means for fusing an image forming substance to a sheet, the means for fusing having, means for heating the means for fusing to a temperature sufficient to fuse an image forming substance to a sheet, the means for heating having, a hollow roller being made of a conductive material and having an inner surface, a coil arranged in a hollow portion of the hollow roller, the coil having a conductor that is configured to carry an electrical current that induces a current in, and heats, the conductive material of the hollow roller, a bobbin being made of an electrically insulating resin, the bobbin arranged inside the coil, a surface of the bobbin having a recess configured to receive at least a portion of the conductor, the recess being a continuous spiral slot extending between ends of the bobbin, and means for maintaining a gap between the hollow roller and the coil, wherein, the means for maintaining a gap is integral with the bobbin, made of an electrically insulating material, disposed between the bobbin and the inner surface of the hollow roller so as to maintain a gap between the hollow roller and the coil, and is arranged on circumferential surfaces of both ends of the bobbin and near a central portion of the bobbin, and the conductor of the coil is wound along the bobbin and disposed within the recess so as to form windings of the coil.

* * * * *